US012396539B2

(12) United States Patent
Pavkov et al.

(10) Patent No.: US 12,396,539 B2
(45) Date of Patent: Aug. 26, 2025

(54) HAIR CLAW CLIPS HAVING JAW BODIES FORMED WITH INDICIA PORTIONS AND METHODS OF FORMING HAIR CLAW CLIPS HAVING INDICIA PORTIONS

(71) Applicant: Fizzy LLC, Hilliard, OH (US)

(72) Inventors: Veronica Ann Pavkov, Doylestown, OH (US); Rachel Sabo Friedmann, Dublin, OH (US)

(73) Assignee: Fizzy LLC, Hilliard, OH (US)

( * ) Notice: Subject to any disclaimer, the term of this patent is extended or adjusted under 35 U.S.C. 154(b) by 0 days.

(21) Appl. No.: 18/228,172

(22) Filed: Jul. 31, 2023

(65) Prior Publication Data

US 2025/0040677 A1 Feb. 6, 2025

(51) Int. Cl.
*A45D 8/20* (2006.01)
*A45D 8/00* (2006.01)

(52) U.S. Cl.
CPC ..... *A45D 8/20* (2013.01); *A45D 8/004* (2021.01)

(58) Field of Classification Search
CPC . A45D 8/20; A45D 8/004; A45D 8/24; A45D 8/30; A44C 1/00

(Continued)

(56) References Cited

U.S. PATENT DOCUMENTS

D155,846 S * 11/1949 Solomon ..... D11/56
5,787,905 A * 8/1998 Yasuda ..... A45D 8/20 132/277

(Continued)

FOREIGN PATENT DOCUMENTS

FR 2901102 A1 11/2007
GB 2573302 A 11/2019

(Continued)

OTHER PUBLICATIONS

J bona made, Unique Crystal Rhinestone Love letter Large Brown Black plastic Hair Jewelry Claw Jaw Clip Clamp Pin Grip, Aug. 28, 2019, Etsy, Accessed Apr. 15, 2025 at https://www.etsy.com/shop/jbonamade?ref=shop-header-name&listing_id=482665297&from_page=listing&section_id=17401986 (Year: 2019).*

(Continued)

*Primary Examiner* — Thomas C Barrett
*Assistant Examiner* — Kylie M. Gaspar
(74) *Attorney, Agent, or Firm* — Dinsmore & Shohl LLP

(57) ABSTRACT

A hair claw clip includes a first jaw and a second jaw that is pivotally connected to the first jaw at a hinge. The first and second jaw each has a indicia portion monolithically formed as an integral part of the respective first and second jaw. The indicia portion has at least one opening through the respective first and second jaw that forms part of a character that can be read from a side of the respective first and second jaw. Each first and second jaw further includes a jaw body forming a lower part of the indicia portion and a handle portion that extends outward from the jaw body at an angle to the jaw body. The handle portion forms an upper part of the indicia portion. The hinge is located between the handle portions of the first and second jaws. The first and second jaws and the indicia portion share an outermost first terminal edge and an outermost second terminal edge opposite from the first terminal edge. The handle portion and upper part of the indicia portion extend across entire widths of the first and second jaws from the outermost first terminal edge to the outermost second terminal edge.

16 Claims, 7 Drawing Sheets

(58) Field of Classification Search
USPC ..... D28/42, 39, 40–41, 27; 132/273, 275, 132/276, 277, 278, 279
See application file for complete search history.

(56) References Cited

U.S. PATENT DOCUMENTS

| | | | | | |
|---|---|---|---|---|---|
| 6,142,159 | A | * | 11/2000 | Lloyd | A45D 8/14 132/273 |
| 6,189,544 | B1 | | 2/2001 | Potut | |
| D473,678 | S | * | 4/2003 | Shyu | D28/40 |
| D486,605 | S | * | 2/2004 | Walker | D28/40 |
| D580,104 | S | * | 11/2008 | Pichon | D28/39 |
| D583,993 | S | * | 12/2008 | Pichon | D28/39 |
| 8,186,364 | B2 | | 5/2012 | Silva | |
| 8,899,244 | B2 | | 12/2014 | Faust | |
| 10,575,576 | B2 | | 3/2020 | Hayes | |
| D982,234 | S | * | 3/2023 | Chen | D28/40 |

FOREIGN PATENT DOCUMENTS

| | | | |
|---|---|---|---|
| KR | 1020020039650 | A | 5/2002 |
| KR | 200306880 | Y1 | 2/2003 |
| WO | 2021247657 | A1 | 12/2021 |

OTHER PUBLICATIONS

Bondep, Love Claw, Jan. 24, 2022, Accessed Apr. 15, 2025 at https://bondep.com/collections/icons-hair-claws, date provided by https://web.archive.org/web/20220124002305/https://bondep.com/collections/hair-claws#expand (Year: 2022).*

Amazon.com "2 Pack Rhinestones Rose Gold Big Hair Claw, 2 Pack Tulip Flower Large Hair Claw Clips for Metal Alloy Fancy Hair Barrette Decorative Flowers Hair Clamp for Women Thick Hair" (https://www.amazon.com/Rhinestones-Flower-Barrette-Decorative-Flowers/dp/B0BD438GBG).

Alibaba.com, "Genya 4.4cm Mini Alloy Claw Clip Letter Hair Clips Star Words Hair Catch Jaw Clamp for Thin Hair" (https://www.alibaba.com/product-detail/Genya-4-4cm-Mini-Alloy-Claw_62534597001.html).

Alibaba.com, "Factory Hot Sales New Style Hair Accessories Fashion Hairpin Cute Side Clip Girl Hair Clips for Women" (https://www.alibaba.com/product-detail/factory-hot-sales-new-Style-Hair_1600704415496.html).

Poshmark.com "Chanel Hair Clip" (https://poshmark.com/listing/Chanel-hair-clip-62c87ac167bd91dc36e513a6).

Aliexpress.com "Acetate Hair Claw Women Hair Clip Vintage Geometry Hollow Square Hair Scoop Women Girls Hair Accessories Metal Headwear" (https://tr.aliexpress.com/item/1005002387836750.html).

* cited by examiner

HAIR CLAW CLIPS HAVING JAW BODIES FORMED WITH INDICIA PORTIONS AND METHODS OF FORMING HAIR CLAW CLIPS HAVING INDICIA PORTIONS

TECHNICAL FIELD

The present specification generally relates to hair claw clips and methods of forming claw clips and, more particularly, to hair claw clips having jaw bodies formed of characters.

BACKGROUND

Hair claw clips are known that are used to hold hair together. The hair claw clips often include a pair of jaws that can spread open to grasp hair and then come together to hold the hair. Each jaw may include tines that interlock to hold the hair.

What is needed are other hair claw clips for holding hair together.

SUMMARY

In one embodiment, a hair claw clip includes a first jaw and a second jaw that is pivotally connected to the first jaw at a hinge. The first and second jaw each has a indicia portion monolithically formed as an integral part of the respective first and second jaw. The indicia portion has at least one opening through the respective first and second jaw that forms part of a character that can be read from a side of the respective first and second jaw. Each first and second jaw further includes a jaw body forming a lower part of the indicia portion and a handle portion that extends outward from the jaw body at an angle to the jaw body. The handle portion forms an upper part of the indicia portion. The hinge is located between the handle portions of the first and second jaws. The first and second jaws and the indicia portion share an outermost first terminal edge and an outermost second terminal edge opposite from the first terminal edge. The handle portion and upper part of the indicia portion extend across entire widths of the first and second jaws from the outermost first terminal edge to the outermost second terminal edge.

In another embodiment, a hair claw clip includes a first jaw and a second jaw that is pivotally connected to the first jaw at a hinge. The first and second jaw each has a indicia portion monolithically formed as an integral part of the respective first and second jaw. The indicia portion has at least one opening through the respective first and second jaw that forms part of multiple characters that can be read from a side of the respective first and second jaw. Each first and second jaw further includes a jaw body forming a lower part of the indicia portion and a handle portion that extends outward from the jaw body at an angle to the jaw body. The handle portion forms an upper part of the indicia portion. The hinge is located between the handle portions of the first and second jaws. The first and second jaws and the indicia portion share an outermost first terminal edge and an outermost second terminal edge opposite from the first terminal edge. The handle portion and upper part of the indicia portion extend across the multiple characters.

In another embodiment, a method of forming a hair claw clip is provided. The method includes molding first and second jaws each having a indicia portion monolithically formed as an integral part of the respective first and second jaw. The indicia portion has at least one opening through the respective first and second jaw that forms part of a character that can be read from a side of the respective first and second jaw. Each first and second jaw further includes a jaw body forming a lower part of the indicia portion and a handle portion that extends outward from the jaw body at an angle to the jaw body. The handle portion forms an upper part of the indicia portion, the hinge being located between the handle portions of the first and second jaws. The first and second jaws and the indicia portion share an outermost first terminal edge and an outermost second terminal edge opposite from the first terminal edge. The handle portion and upper part of the indicia portion extend across entire widths of the first and second jaws from the outermost first terminal edge to the outermost second terminal edge. The first and second jaws are pivotally connected together using a hinge.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to hair claw clips that form characters that can be words, numbers, letter, symbols, etc. using the jaws of the hair claw clips. The hair claw clip include a first jaw and a second jaw that is pivotally connected to the first jaw at a hinge. The first and second jaw each have a indicia portion monolithically formed as an integral part of the respective first and second jaw. The indicia portion has at least one opening through the respective first and second jaw that forms part of a character that can be read from a side of the respective first and second jaw. Each first and second jaw further includes a jaw body forming a lower part of the indicia portion and a handle portion that extends outward from the jaw body at an angle to the jaw body. The handle portion forms an upper part of the indicia portion. The hinge is located between the handle portions of the first and second jaws. The first and second jaws and the indicia portion share an outermost first terminal edge and an outermost second terminal edge opposite the first terminal edge. The handle portion and upper part of the indicia portion extend across entire widths of the first and second jaws from the outermost first terminal edge to the outermost second terminal edge.

As used herein, the term "indicia" refers to indicating marks, signs or indications. As used herein, the term "character" refers to a symbol, such as a number or letter, that represents information.

Figure 1:
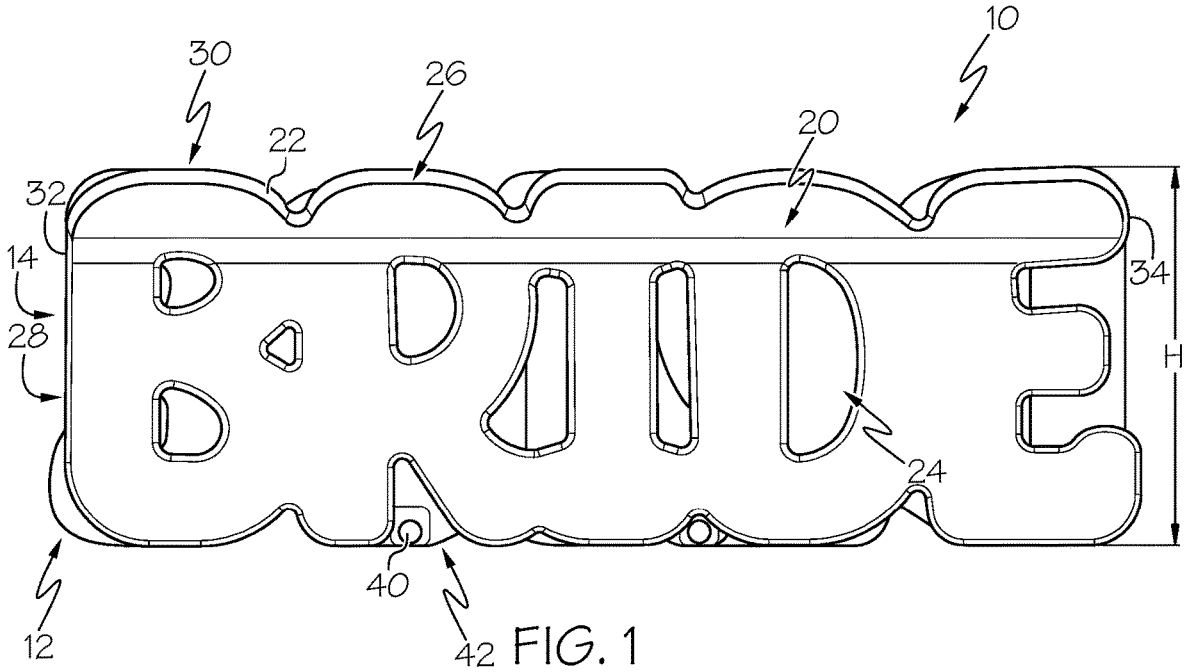
FIG. 1 illustrates a diagrammatic side view of a hair claw clip including indicia portion, according to one or more embodiments shown and described herein.
Figure 2:
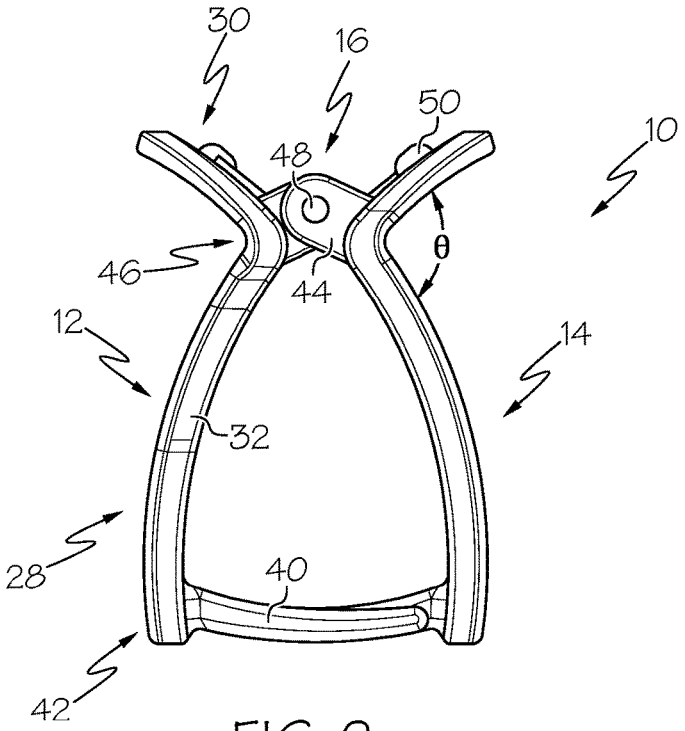
FIG. 2 illustrates an end view of the hair claw clip of FIG. 1, according to one or more embodiments shown and described herein.
Figure 3:
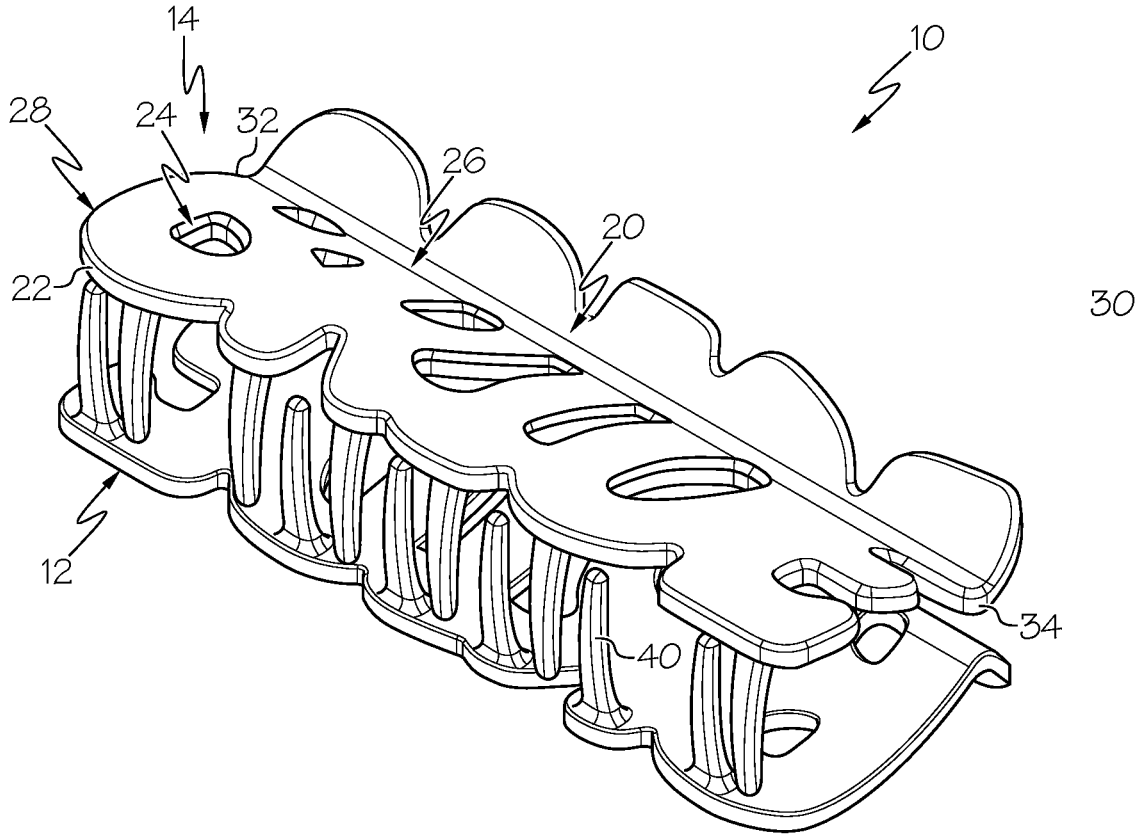
FIG. 3 illustrates a bottom perspective view of the hair claw clip of FIG. 1, according to one or more embodiments shown and described herein.
Figure 4:
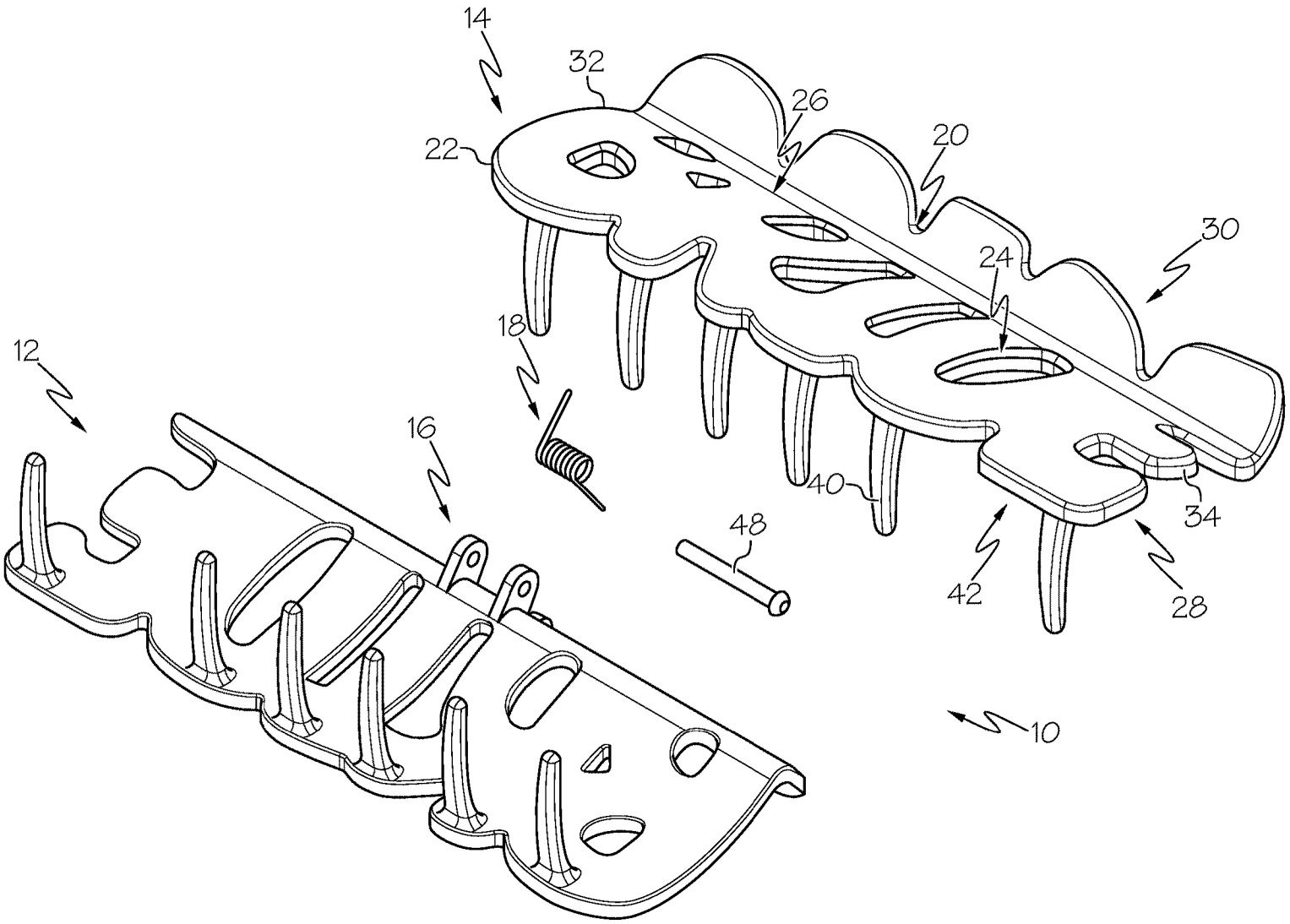
FIG. 4 illustrates an exploded, perspective view of the hair claw clip of FIG. 1, according to one or more embodiments shown and described herein.
Figure 5:
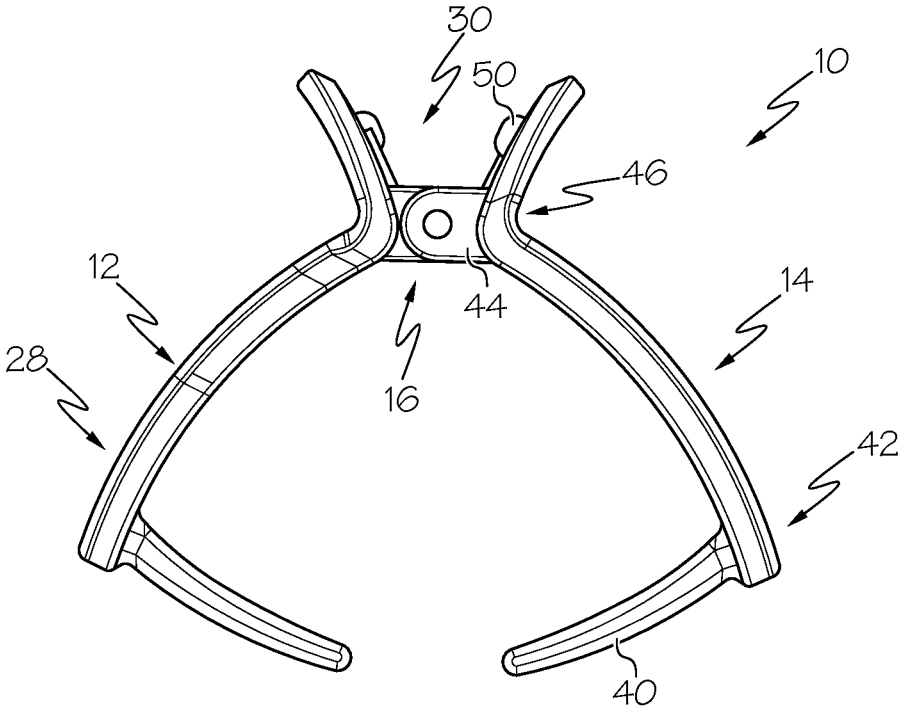
FIG. 5 illustrates the hair law clip of FIG. 1 in an open position, according to one or more embodiments shown and described herein.

Referring to FIGS. 1-5, a hair claw clip 10 includes a first jaw 12 and a second jaw 14. The first and second jaws 12 and 14 are pivotally connected together at a hinge 16. The jaws may be spring-biased toward a clasped position by a spring 18 (FIG. 4), as shown by FIG. 2 and may be manually opened to an open position, as shown by FIG. 5. The first and second jaws 12 and 14 each include an indicia portion 20 that is monolithically formed as an integral part of the first and second jaws 12 and 14. To form the indicia portion 20, the first and second jaws 12 and 14 have curves 22 and openings 24 through the first and second jaws 12 and 14 that forms part of a character 26 that can be read from a side of the first and second jaws 12 and 14.

Each first and second jaw 12 and 14 further includes a jaw body 28 forming a lower part of the indicia portion 20 and a handle portion 30 that extends outward from the jaw body 28 at an angle θ to the jaw body 28. In some embodiments, the angle θ may be between about 95 degrees and about 115 degrees, such as about 103 degrees. The handle portion 30 forms an upper part of the indicia portion 20. The hinge 16 is located between the handle portions 30 of the first and second jaws 12 and 14. The first and second jaws 12 and 14 and the indicia portion 20 share an outermost first terminal edge 32 and an outermost second terminal edge 34 opposite from the first terminal edge 32. The handle portion 30 and upper part of the indicia portion 20 extend across entire widths of the first and second jaws 12 and 14 from the outermost first terminal edge 32 to the outermost second terminal edge 34.

In particular, in the embodiment of FIGS. 1-5, the jaw body 28 is generally arcuate in cross-sectional shape (FIG. 2) and includes the lower part of the indicia portion 20 that includes lower portions of the characters 26 that form a word, in this example, "BRIDE." The word "BRIDE" extends from the outermost first terminal edge 32 to the outermost second terminal edge 34 such that contours of the word "BRIDE" define both outermost first and second terminal edges 32 and 34 of the jaw body 28. In some embodiments, the jaw body 28 forms at least about 50 percent of a total height H of each character 26, such as at least about 60 percent of a height H of each character, such as at least about 70 percent of a height H of each character, such as at least about 80 percent of a height H of each character, such as at least about 90 percent of a height H of each character. In some embodiments, the amount of height H of each character 26 the jaw body 28 forms is substantially the same such that the word appears relatively rectangular including the jaw body 28 and the handle portion 30.

The upper part of the indicia portion 20 is formed by the handle portion 30, which also extends from the outermost first terminal edge 32 to the outermost second terminal edge 34 such that contours of the word "BRIDE" define both outermost first and second terminal edges 32 and 34 of the handle portion 30. In some embodiments, the handle portion 30 forms no more than about 50 percent of a total height H of each character 26, such as no more than about 40 percent of a height H of each character, such as no more than about 30 percent of a height H of each character, such as no more than about 20 percent of a height H of each character, such as no more than about 10 percent of a height H of each character. In some embodiments, the amount of height H of each character 26 the handle portion 30 forms is substantially the same such that the word appears relatively rectangular including the jaw body 28 and the handle portion 30.

The word "BRIDE" of the first and second jaws 12 and 14 are spelled in opposite directions. In this regard, the indicia portion 20 of the first jaw 12 may be considered a mirror image of the indicia portion 20 of the second jaw 14. Such a mirror image arrangement facilitates reading of the indicia portion 20 from both sides of the hair claw clip 10 depending on the positions of the wearer of the hair claw clip 10 and the viewer of the hair claw clip 10.

Referring particularly to FIG. 2, tines 40 extend inward toward each other from bottom portions 42 of each jaw body 28. In some embodiments, each character 26 may include at least one tine 40 that extends inward such that tines 40 of the first and second jaws 12 and 14 interlock with the first and second jaws 12 and 14 in the clasped position. Hinge portions 44 of the hinge 16 extend inward toward each other from bottom portions 46 of the handle portion 30. A pin 48 may be threaded through openings 48 of the hinge portions 44 to pivotally couple the hinge portions 44 together. The spring 18 (FIG. 4) may be used to bias the first and second jaws 12 and 14 toward the clasped position. Stops 50 may be provided on the handle portion 30 that can limit the amount of rotation of the first and second jaws 12 and 14 toward the open position (FIG. 5).

Figure 6:
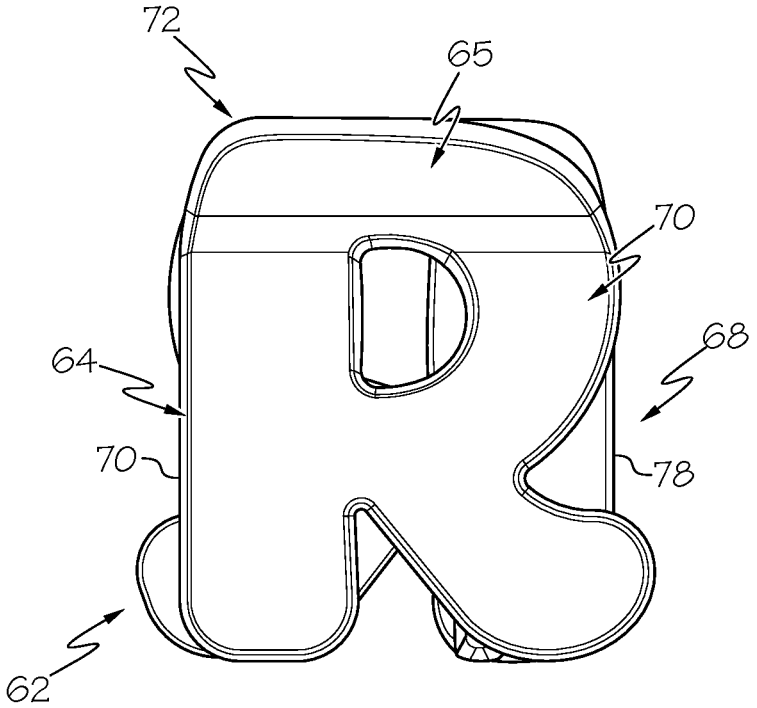
FIG. 6 illustrates a side view of another hair claw clip, according to one or more embodiments shown and described herein.
Figure 7:
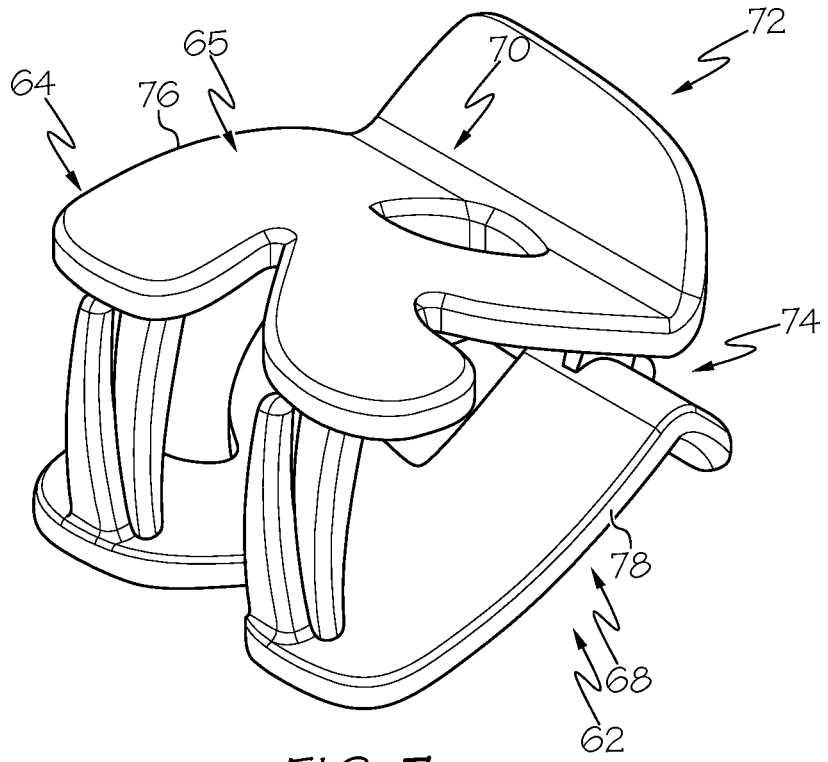
FIG. 7 illustrates a bottom, perspective view of the hair claw clip of FIG. 6, according to one or more embodiments shown and described herein.
Figure 8:
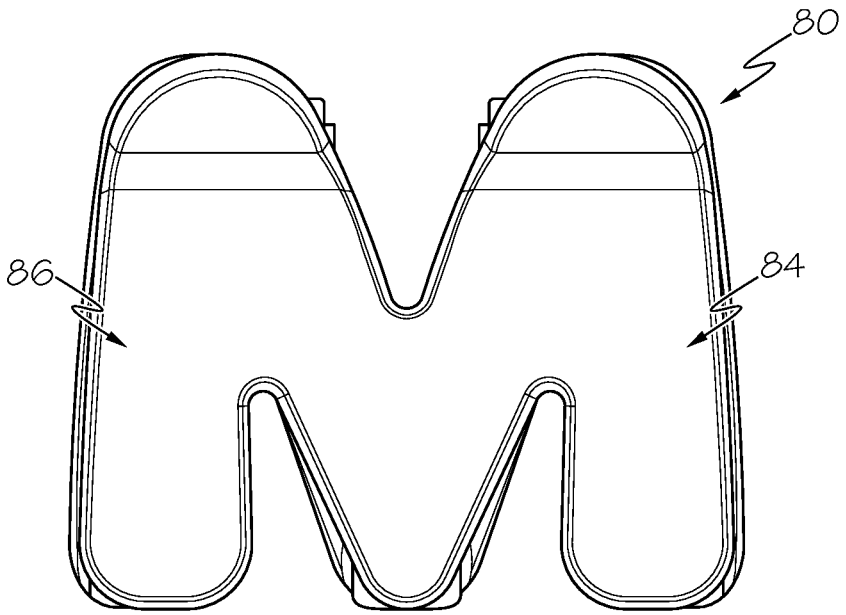
FIG. 8 illustrates a side view of another hair claw clip, according to one or more embodiments shown and described herein.
Figure 9:
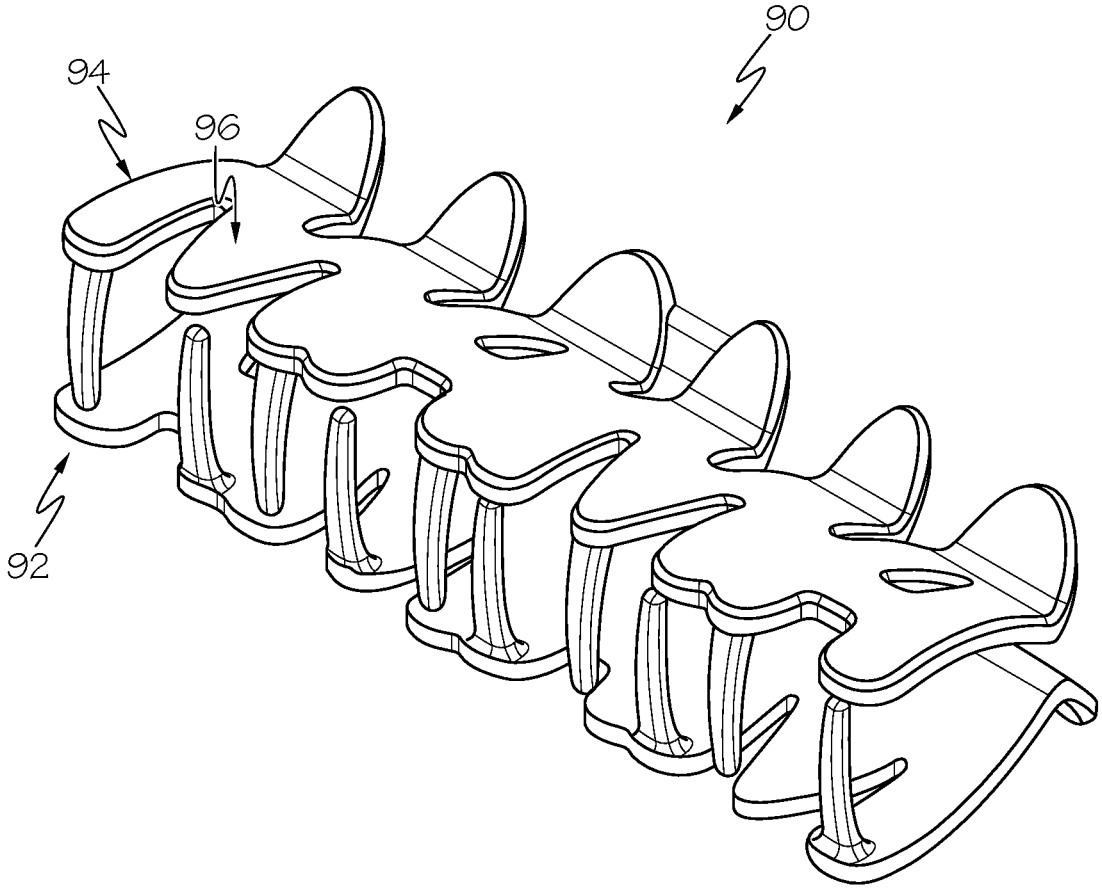
FIG. 9 illustrates another embodiment of a hair claw clip, according to one or more embodiments shown and described herein.
Figure 10:
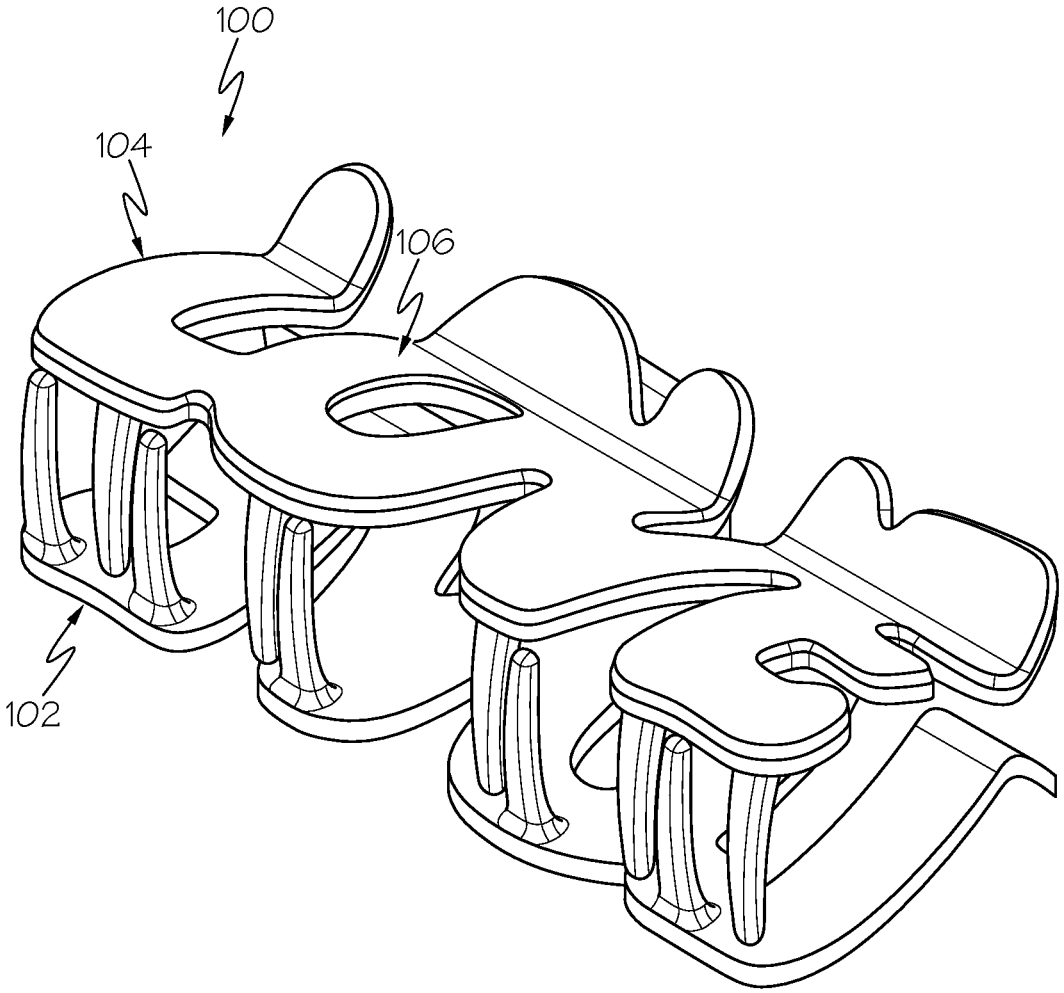
FIG. 10 illustrates another embodiment of a hair claw clip, according to one or more embodiments shown and described herein.

The indicia portion 20 may include one or more characters 26 that form any word or even only a single letter that defines the outermost first and second terminal edges 32 and 34. For example, FIGS. 6 and 7 illustrate a hair claw clip 60 that includes first and second jaws 62 and 64 that form a character 65 that forms the letter "R." In particular, the first and second jaws 62 and 64 include a jaw body 68 forming a lower part of an indicia portion 70 and a handle portion 72 that extends outward from the jaw body 68, as discussed above. The handle portion 72 forms an upper part of the indicia portion 70. A hinge 74 is located between the handle portions 72 of the first and second jaws 62 and 64. The first and second jaws 62 and 64 and the indicia portion 70 share an outermost first terminal edge 76 and an outermost second terminal edge 78 opposite from the first terminal edge 76. The handle portion 72 and upper part of the indicia portion 70 extend across entire widths of the first and second jaws 62 and 64 from the outermost first terminal edge 76 to the outermost second terminal edge 78, as discussed above regarding hair claw clip 10. FIG. 8 shows another embodiment of a hair claw clip 80 that includes first and second jaws 82 and 84 that form a character 86 that forms the letter "M." FIG. 9 shows another embodiment of a hair claw clip 90 that includes first and second jaws 92 and 94 comprising characters 96 that form the word "MAMA" and FIG. 10 shows an embodiment of a hair claw clip 100 that includes first and second jaws 102 and 104 comprising characters 106 that form the word "LOVE."

The above-described hair claw clips include first and second jaws that include jaw bodies and handle portions that together form an indicia portion comprising one or more characters formed as a monolithic part of the first and second jaws. For example, the first and second jaws may be molded from a plastic resin in shapes that integrally form the one or more characters. Both the handle portion and the jaw body form the indicia portion that extends from one outermost terminal edge of both the handle portion and the jaw body to an opposite outermost terminal edge of the handle portion and the jaw body.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A hair claw clip comprising:

a first jaw and a second jaw that is pivotally connected to the first jaw at a hinge, the first and second jaw each having an indicia portion monolithically formed as an integral part of the respective first and second jaw, the indicia portion having at least one opening through the respective first and second jaw that forms part of a character that can be read from a side of the respective first and second jaw, each first and second jaw further comprising:

a jaw body forming a lower part of the indicia portion; and a handle portion that extends outward from the jaw body at an angle to the jaw body forming a bend therebetween, the handle portion forming an upper part of the indicia portion, the hinge being located between the handle portions of the first and second jaws;

wherein the first and second jaws and the indicia portions share an outermost first terminal edge and an outermost second terminal edge opposite from the outermost first terminal edge, the hinge forming a pivot axis that extends from the outermost first terminal edge to the outermost second terminal edge such that the upper parts of the indicia portions of the first and second jaws from the outermost first terminal edge to the outermost second terminal edge pivot about the pivot axis along with the lower parts of the indicia portions of the first and second jaws from the outermost first terminal edge to the outermost second terminal edge;

wherein the handle portion and upper part of the indicia portion extend across widths of the first and second jaws forming the upper part of the indicia portion from the outermost first terminal edge to the outermost second terminal edge;

wherein the indicia portion of the first jaw forms a first word and comprises the respective character that is an outermost first character forming a first letter whose outermost first contour is configured to form the outermost first terminal edge of the jaw body and handle portion of the first jaw and an outermost second character forming a second letter different in shape than the first letter whose outermost second contour is different in shape than the outermost first contour and is configured to form the outermost second terminal edge of the jaw body and the handle portion of the first jaw;

wherein the indicia portion of the second jaw forms a second word and comprises the respective character that is an outermost third character forming a third letter that is a mirror image of the first letter and whose outermost third contour is configured to form the outermost second terminal edge of the jaw body and handle portion of the second jaw and an outermost fourth character forming a fourth letter that is a mirror image of the second letter whose outermost fourth contour is different in shape than the outermost third contour and is configured to form the outermost first terminal edge of the jaw body and handle portion of the second jaw;

wherein the bends of the first and second jaws extend parallel to the pivot axis and through all characters of each of the first and second words of the respective first and second jaws such that all characters of each of the first and second jaws form the respective handle portions.

2. The hair claw clip of claim 1, wherein the first jaw includes the handle portion comprising a hinge portion that extends outward from the respective handle portion and the second jaw includes another hinge portion extending outward from the respective handle portion, the hinge portions being pivotally coupled together to form the hinge.

3. The hair claw clip of claim 1, wherein the jaw body forms at least 70 percent of a height of the character.

4. The hair claw clip of claim 1, wherein the handle portion forms no more than 30 percent of a height of the character.

5. The hair claw clip of claim 1, wherein the first word is a mirror image of the second word.

6. The hair claw clip of claim 1, wherein the pivot axis extends perpendicular to and intersects the outermost first and second terminal edges.

7. The hair claw clip of claim 1, wherein all characters of the first and second words comprise at least one tine that extends inward from the respective jaw bodies.

8. A hair claw clip comprising:

a first jaw and a second jaw that is pivotally connected to the first jaw at a hinge, the first and second jaw each having an indicia portion monolithically formed as an integral part of the respective first and second jaw, the indicia portion of each first and second jaw having at least one opening through the respective first and second jaw that forms part of multiple characters that can be read from a side of the respective first and second jaw, each first and second jaw further comprising:

a jaw body forming a lower part of the indicia portion; and a handle portion that extends outward from the jaw body at an angle to the jaw body forming a bend therebetween, the handle portion forming an upper part of the indicia portion, the hinge being located between the handle portions of the first and second jaws;

wherein the first and second jaws and the indicia portion share an outermost first terminal edge and an outermost second terminal edge opposite from the outermost first terminal edge, the hinge forming a pivot axis that extends from the outermost first terminal edge to the outermost second terminal edge such that the upper parts of the indicia portions of the first and second jaws from the outermost first terminal edge to the outermost second terminal edge pivot about the pivot axis along with the lower parts of the indicia portions of the first and second jaws from the outermost first terminal edge to the outermost second terminal edge;

wherein the handle portion and upper part of the indicia portion extend across widths of the first and second jaws forming the upper part of the indicia portion from the outermost first terminal edge to the second terminal edge;

wherein the indicia portion of the first jaw forms a first word and comprises the multiple characters including an outermost first character forming a first letter whose outermost first contour is configured to form the outermost first terminal edge of the jaw body and handle portion of the first jaw and an outermost second character forming a second letter different in shape than the first letter whose outermost second contour is different in shape than the outermost first contour and is configured to form the outermost second terminal edge of the jaw body and the handle portion of the first jaw;

wherein the indicia portion of the second jaw forms a second word and comprises the multiple characters including an outermost third character forming a third letter that is a mirror image of the first letter and whose outermost third contour is configured to form the outermost second terminal edge of the jaw body and handle portion of the second jaw and an outermost fourth character forming a fourth letter that is a mirror image of the second letter whose outermost fourth contour is different in shape than the outermost third contour and is configured to form the outermost first terminal edge of the jaw body and handle portion of the second jaw;

wherein the bends of the first and second jaws extend parallel to the pivot axis and through all of the multiple characters of each of the first and second words of the respective first and second jaws such that all of the multiple characters of each of the first and second jaws form the respective handle portions.

9. The hair claw clip of claim 8, wherein the first jaw includes the handle portion comprising a hinge portion that extends outward from the respective handle portion and the second jaw includes another hinge portion extending outward from the respective handle portion, the hinge portions being pivotally coupled together to form the hinge.

10. The hair claw clip of claim 8, wherein the jaw body forms at least 70 percent of a height of the character.

11. The hair claw clip of claim 8, wherein the handle portion forms no more than 30 percent of a height of the multiple characters.

12. The hair claw clip of claim 8, wherein the pivot axis extends perpendicular to and intersects the outermost first and second terminal edges.

13. A method of forming a hair claw clip, the method comprising:

molding first and second jaws each having an indicia portion monolithically formed as an integral part of the respective first and second jaw, the indicia portion having at least one opening through the respective first and second jaw that forms part of a character that can be read from a side of the respective first and second jaw, each first and second jaw further comprising:

a jaw body forming a lower part of the indicia portion; and a handle portion that extends outward from the jaw body at an angle to the jaw body forming a bend therebetween, the handle portion forming an upper part of the indicia portion;

pivotally connecting the first and second jaws together using a hinge forming a pivot axis;

wherein the first and second jaws and the indicia portion share an outermost first terminal edge and an outermost second terminal edge opposite from the outermost first terminal edge, the hinge forming the pivot axis that extends from the outermost first terminal edge to the outermost second terminal edge such that the upper parts of the indicia portions of the first and second jaws from the outermost first terminal edge to the outermost second terminal edge pivot about the pivot axis along with the lower parts of the indicia portions of the first and second jaws from the outermost first terminal edge to the outermost second terminal edge;

wherein the handle portion and upper part of the indicia portion extend across widths of the first and second jaws forming the upper part of the indicia portion from the outermost first terminal edge to the outermost second terminal edge;

wherein the indicia portion of the first jaw forms a first word and comprises the respective character that is an outermost first character forming a first letter whose outermost first contour is configured to form the outermost first terminal edge of the jaw body and handle portion of the first jaw and an outermost second character forming a second letter different in shape than the first letter whose outermost second contour is different in shape than the outermost first contour and is configured to form the outermost second terminal edge of the jaw body and the handle portion of the first jaw;

wherein the indicia portion of the second jaw forms a second word and comprises the respective character that is an outermost third character forming a third letter that is a mirror image of the first letter and whose outermost third contour is configured to form the outermost second terminal edge of the jaw body and handle portion of the second jaw and an outermost fourth character forming a fourth letter that is a mirror image of the second letter whose outermost fourth contour is different in shape than the outermost third contour and is configured to form the outermost first terminal edge of the jaw body and handle portion of the second jaw;

wherein the bends of the first and second jaws extend parallel to the pivot axis and through all characters of each of the first and second words of the respective first and second jaws such that all characters of each of the first and second jaws form part of the respective handle portions.

14. The method of claim 13, wherein the first jaw includes the handle portion comprising a hinge portion that extends outward from the respective handle portion and the second jaw includes another hinge portion extending outward from the respective handle portion, the hinge portions being pivotally coupled together to form the hinge.

15. The method of claim 13, wherein the step of molding includes forming the jaw body such that the jaw body is at least 70 percent of a height of the character.

16. The method of claim 13, wherein the pivot axis extends perpendicular to and intersects the outermost first and second terminal edges.

* * * * *